US007708345B2

(12) United States Patent
Grabowski et al.

(10) Patent No.: US 7,708,345 B2
(45) Date of Patent: May 4, 2010

(54) RECLINER

(75) Inventors: Daniel Grabowski, Grand Rapids, MI (US); John Henry Heyder, Orleans, IN (US); Jeremy Franklin Foreman, Bedford, IN (US); Michael A. Johnson, Burlington, IA (US); Aaron Jon Schradin, Holland, MI (US)

(73) Assignee: HNI Technologies Inc., Mascatine, IA (US)

( * ) Notice: Subject to any disclaimer, the term of this patent is extended or adjusted under 35 U.S.C. 154(b) by 651 days.

(21) Appl. No.: 11/556,464

(22) Filed: Nov. 3, 2006

(65) Prior Publication Data

US 2007/0108823 A1 May 17, 2007

Related U.S. Application Data

(60) Provisional application No. 60/733,815, filed on Nov. 4, 2005, provisional application No. 60/733,866, filed on Nov. 4, 2005.

(51) Int. Cl.
*A47C 1/024* (2006.01)

(52) U.S. Cl. ..... 297/354.12; 297/361.1; 297/440.24; 297/374

(58) Field of Classification Search ..... 297/354.12, 297/316, 320, 361.1, 440.24, 450.1, 440.15, 297/354.1, 374
See application file for complete search history.

(56) References Cited

U.S. PATENT DOCUMENTS

| | | | |
|---|---|---|---|
| 1,771,231 | A | 7/1930 | Parkinson |
| 3,528,096 | A | 9/1970 | Moberg |
| 3,658,382 | A | 4/1972 | Anderson |
| 3,874,729 | A | 4/1975 | Blodee |
| 4,043,591 | A | 8/1977 | Lehmann |
| 4,060,277 | A | 11/1977 | Leib |
| 4,311,337 | A | 1/1982 | Brunn |
| 4,602,817 | A | 7/1986 | Raftery |
| 4,828,324 | A | 5/1989 | Putnam |
| 4,848,843 | A | 7/1989 | Gibbs |
| 4,919,485 | A | 4/1990 | Guichon |
| 5,112,110 | A | 5/1992 | Perkins |
| 5,263,764 | A | 11/1993 | Laughlin et al. |
| 5,277,476 | A | 1/1994 | Caldwell |
| 5,292,177 | A | 3/1994 | Balderi et al. |
| 5,306,072 | A | 4/1994 | Caldwell |
| 5,338,095 | A | 8/1994 | Laughlin et al. |
| 5,431,479 | A | 7/1995 | Leib |
| 5,470,128 | A | 11/1995 | Kerkham |
| 5,551,757 | A | 9/1996 | Glover |
| 5,601,340 | A | 2/1997 | Stout |
| 5,630,644 | A | 5/1997 | LaPointe et al. |
| 5,738,414 | A | 4/1998 | Wieland et al. |
| 5,795,028 | A | 8/1998 | Dussia, Jr. et al. |
| 5,857,742 | A | 1/1999 | Karl et al. |
| 5,890,767 | A | 4/1999 | Chang |
| 5,967,609 | A | 10/1999 | Potter |
| 6,102,476 | A | 8/2000 | May et al. |

(Continued)

*Primary Examiner*—Anthony D Barfield
(74) *Attorney, Agent, or Firm*—Faegre & Benson LLP

(57) ABSTRACT

A recliner has a chair frame that provides support to a seat and back rest. The frame includes a recliner assembly that includes a bracket that is connected to the backrest enabling reclining movement of the backrest as the bracket moves through a correspondingly shaped bracket slot in a recliner base plate, and where the bracket rotates about an axis that approximates the position of the rotational axis of the hip of a seated user. The reclining chair can also be part of a modular system of components that enable one or more seating units to be in a spanned or ganged configuration.

20 Claims, 15 Drawing Sheets

U.S. PATENT DOCUMENTS 6,217,120 B1 4/2001 Pugliese
6,227,752 B1 5/2001 Friedrich
6,241,317 B1 6/2001 Wu
6,279,997 B1 8/2001 Moore et al.
6,367,874 B2 4/2002 Casini
6,367,880 B1 4/2002 Niederman et al.
6,412,862 B1 7/2002 Dickerson et al.
6,568,058 B1 5/2003 Wieland et al.
6,595,592 B1 7/2003 Wieland et al.
6,637,812 B2 10/2003 Laughlin et al.
6,688,699 B1 2/2004 Bowie
6,692,079 B2 2/2004 Guillot
6,715,837 B2 4/2004 Niederman et al.
6,739,652 B2 5/2004 Welsh
6,746,086 B1 6/2004 Foster
6,758,450 B2 7/2004 Niederman et al.
6,783,182 B1 8/2004 Gallagher
6,874,850 B2 4/2005 Berkowicz
6,929,320 B2 * 8/2005 Laurent ..... 297/316 X
2005/0017561 A1 * 1/2005 Burmeister et al. . 297/354.12 X

* cited by examiner

RECLINER

CLAIM OF PRIORITY

This application claims priority from U.S. provisional application Ser. No. 60/733,815, filed Nov. 4, 2005, entitled "Recliner," and from U.S. provisional application Ser. No. 60/733,866, filed Nov. 4, 2005, entitled "Modular Furniture Construction," both incorporated herein by reference.

BACKGROUND OF THE INVENTION

The invention relates generally to chairs and more specifically to chair with a compact recliner mechanism. It is desirable in some environments, particularly in lobbies of hospitals and patient rooms where the waiting times are generally more prolonged, to have seating that is comfortable to the user. Additionally, it is important that any options or features that add to the comfort be incorporated into the chair construction in a way that minimizes the number of parts and maximizes the use of common parts among different options, maximizes efficiencies of manufacturing and assembling, maximizes ease of adjustment and yet that results in a visually pleasing design.

SUMMARY OF THE INVENTION

One embodiment of the invention includes a reclining chair that includes:

- a chair frame comprising front and rear frame members, two parallel side frame members each side frame member attachable to the front and rear members;
- a seat supported by at least two frame members;
- a backrest;
- a pair of legs, wherein the frame members are connected to the legs;
- a first and second recliner assembly comprising a bracket, the bracket is attachable to the backrest enabling reclining movement of the backrest as the bracket moves through a correspondingly shaped bracket slot in a recliner base plate, wherein the bracket rotates about an axis that approximates the position of the rotational axis of the hip of a seated user.

Another embodiment of the invention includes a recliner that can be part of a modular system.

BRIEF DESCRIPTION OF THE DRAWINGS

The present invention will hereinafter be described in conjunction with the appended drawing figures wherein like numerals denote like elements.

DETAILED DESCRIPTION OF THE EMBODIMENTS

Figure 1A:
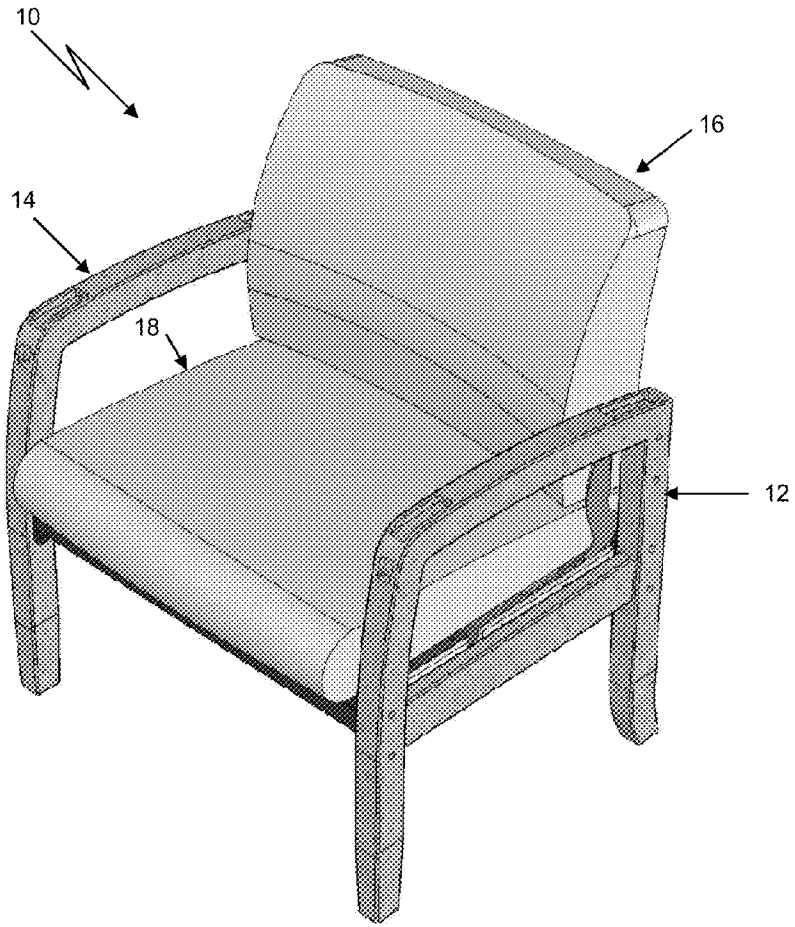
FIG. 1*a* is a perspective view of a fully-assembled chair.

The ensuing detailed description provides exemplary embodiments only, and is not intended to limit the scope, applicability, or configuration of the invention. Rather, the ensuing detailed description of the exemplary embodiments will provide those skilled in the art with an enabling description for implementing the exemplary embodiments of the invention. It being understood that various changes may be made in the function and arrangement of elements without departing from the spirit and scope of the invention.

To aid in describing embodiments of the invention, directional terms may be used in the specification to describe portions of the present invention (e.g., upper, lower, left, right, etc.). These directional terms are merely intended to assist in describing and claiming the invention and are not intended to limit the invention in any way. In addition, reference numerals that are introduced in the specification in association with a drawing figure may be repeated in one or more other figures without additional description in the specification, in order to provide context for other features.

FIG. 1 shows an embodiment of a chair 10 of the present invention, which includes a pair of support members 12 and 14, orientated parallel to each other, spaced apart and the approximate width of the chair, a backrest 16 and a seat 18. The support members 12 and 14 are preferably made of wood, but could be made of other structurally suitable metallic or polymer materials and may be covered with other hard or soft materials. The support members 12 and 14 may be a common part, providing economies of scale and ease of manufacturing or they may have differing features depending upon the intended functionality of the final product. The support members can provide the legs and can extend to a height that will allow for a pair of arms, armrest and structure for mounting the seat 18. In either case, the support members 12, 14 provide an attachment point for the frame 32, which is described in greater detail herein.

If the support members 12, 14 are a common part, the mounting holes 15 on the outer side of each of the arms 12, 14 are preferably arranged in the same configuration as the inner mounting holes 13. If the support members 12, 14 are provided in left and right versions, mounting holes 15 on the outer side of each support member 12, 14 may be provided in a different configuration than the inner mounting holes 13, or may be omitted. If the support members 12, 14 are provided in left and right versions, a center version (see arms 112, 114, FIG. 11) having mounting holes 15 on the outer side of each of the support members 12, 14 arranged in the same configuration as the inner mounting holes 13, is preferably provided for use in ganging configurations (defined below).

Figure 2:
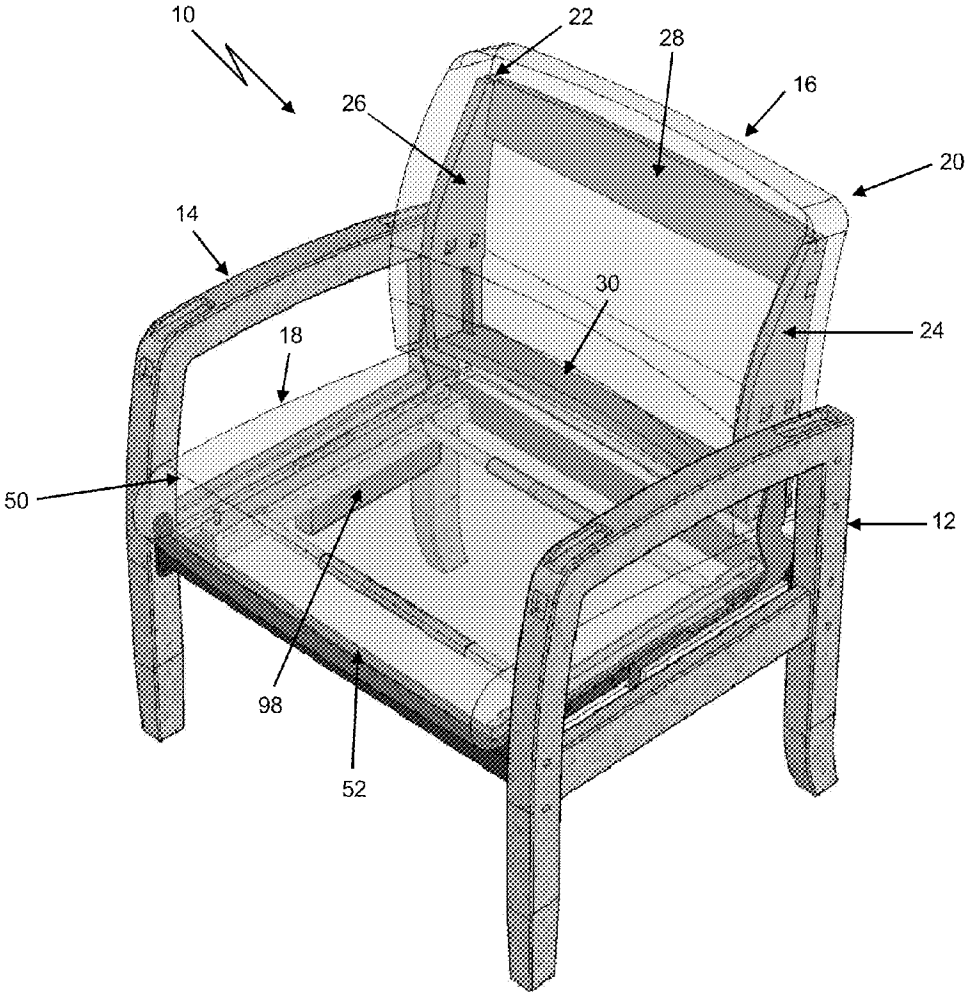
FIG. 2 is a perspective view thereof, in which the seat and backrest cushions are translucent in order to show the internal parts of the chair.

The backrest 16 is best shown in FIG. 2. Its components include a backrest cushion 20 and a backrest support structure 22. In this embodiment, the backrest cushion 20 is shown as a fabric cover over a foam core, but could alternatively comprise other suitable materials, such as wood, polymer, vinyl or leather for example. The backrest support structure 22 consists of two side panels 24 and 26, a top rail 28 and a bottom rail 30. Two filler pieces (not shown) may optionally be included with the side panels 24 and 26. The filler pieces are generally rectangular in cross section and have a length approximately equal to the slot in the lower portion of the side panels 24 and 26. The filler pieces provide increased bearing area for the slots and, if necessary, fill a gap between the side panels 24 and 26 and any mating components. In the case of the wood version shown, these components are assembled and the fastened with conventional techniques, such as slots or grooves in the mating pieces, mechanical fasteners or adhesives. The backrest cushion 20 is attached to the backrest support structure 22 with any suitable conventional means.

Figure 1B:
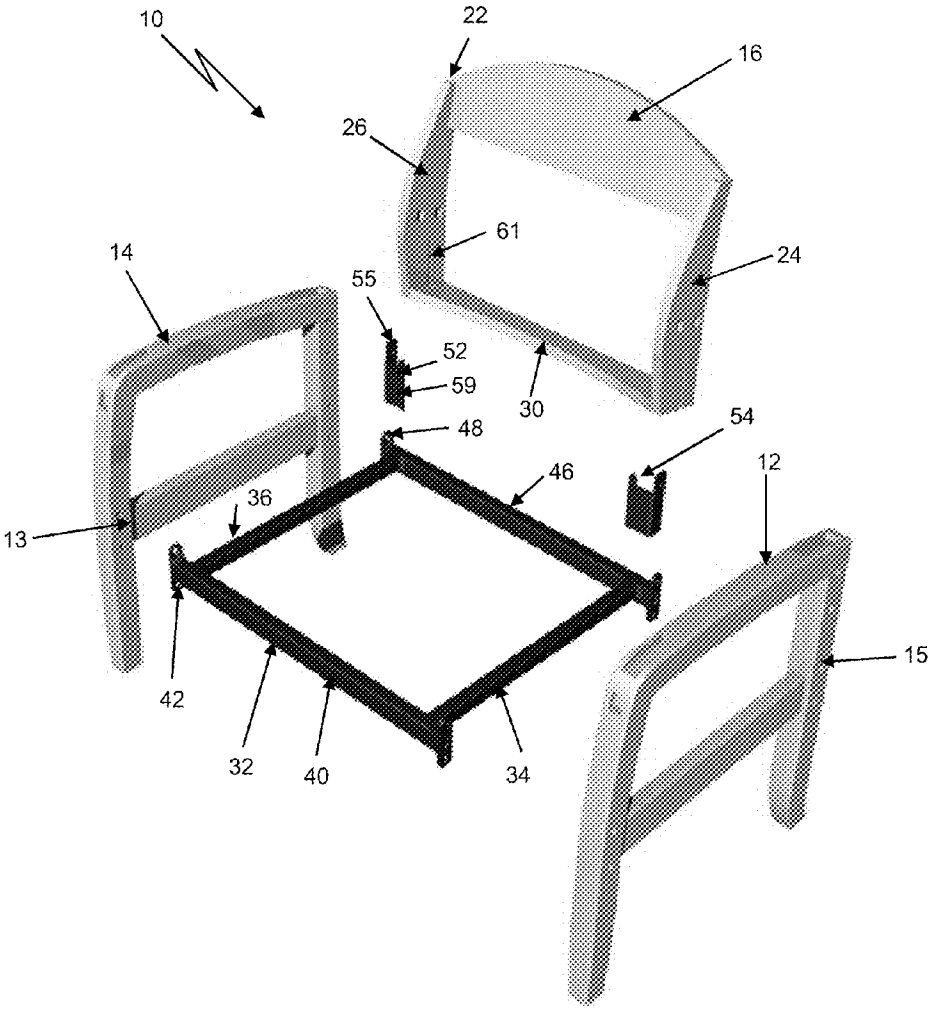
FIG. 1*b* is an exploded perspective view of a chair, in which the seat, seat cushion and backrest cushion have been removed.

In some embodiments of the invention, the backrest 16 is secured to the arms 12, 14 via right and left backrest brackets 54, 55, respectively (FIG. 1*b*). Each of the backrest brackets 54, 55 includes a mounting flange 52, which includes holes formed therein that line up with at least two of the inner holes 13 on the arm 12, 14 to which it is to be attached using screws, bolts or other suitable attachment means. Each of the brackets 54, 55 also includes a backrest flange 59 which slides into a complimentary slot 61 formed in the backrest 16. Any suitable means, such as a screw, may be used to prevent the backrest flange 59 from being removed from the slot 61.

Figure 3:
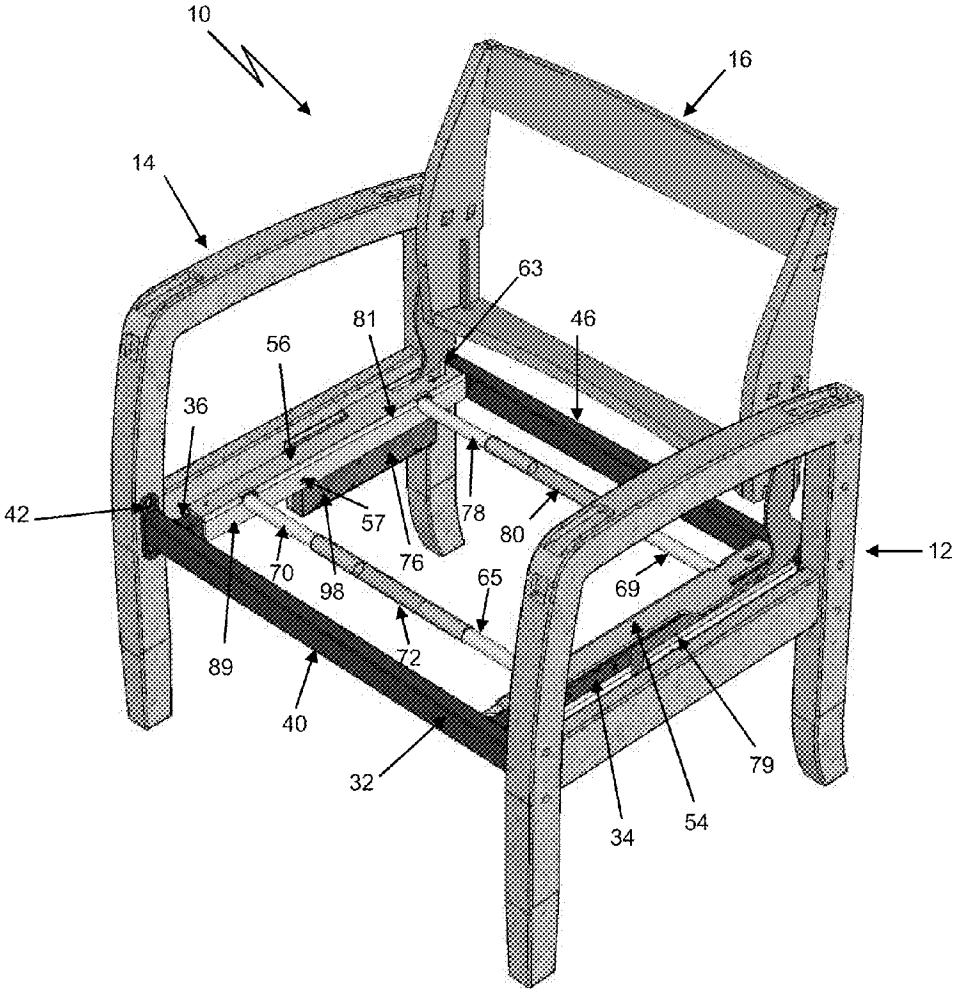
FIG. 3 is a perspective view thereof, in which the seat cushion, backrest cushion and seat panel have been removed to more clearly show the structure components.
Figure 4:
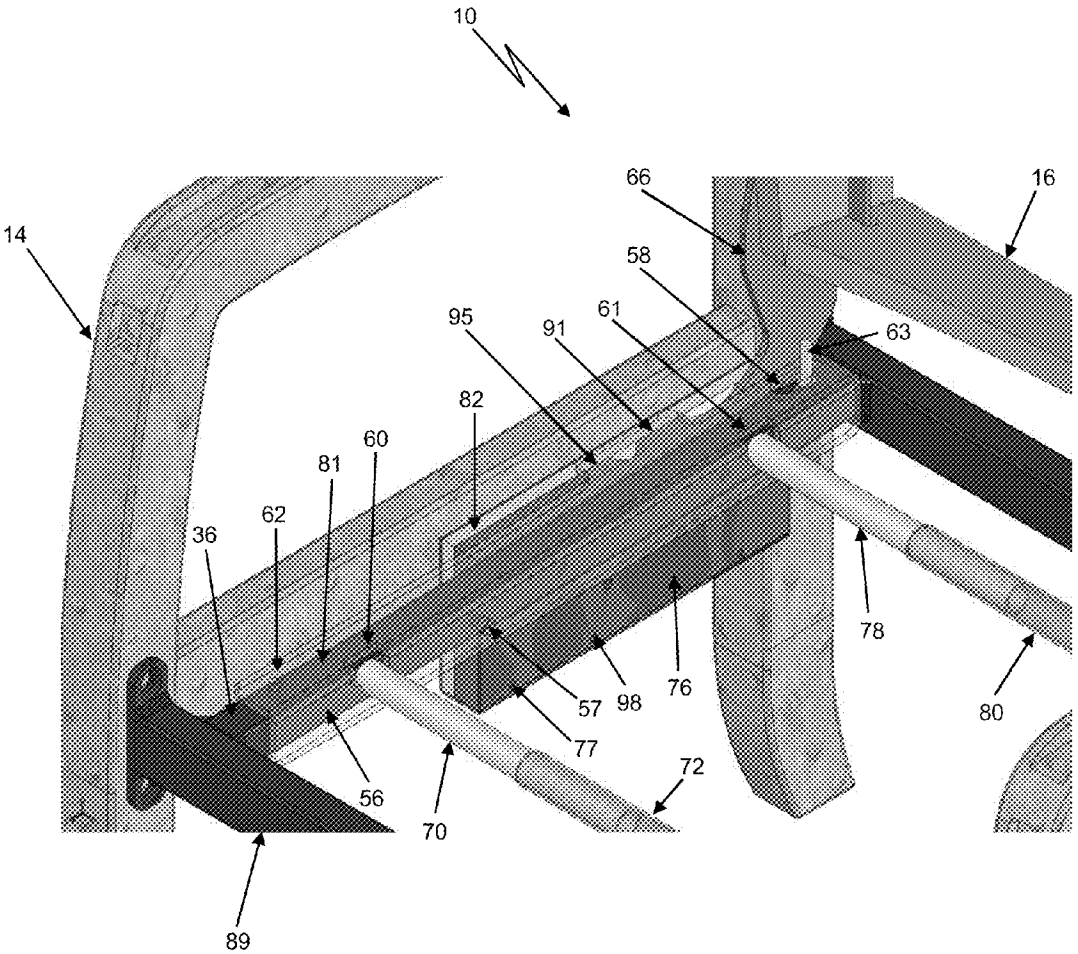
FIG. 4 is an enlarged partial view of the left side of FIG. 3 with the left seat angle translucent.
Figure 5:
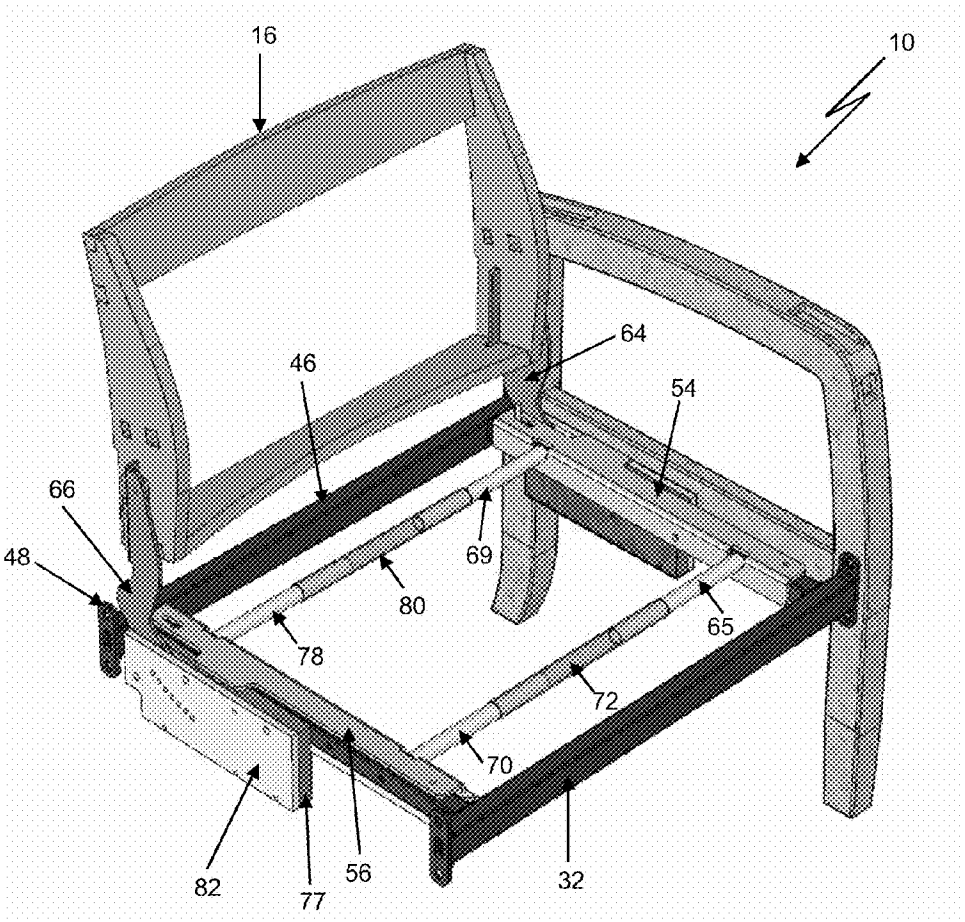
FIG. 5 is a perspective view thereof, with the left arm removed.
Figure 6:
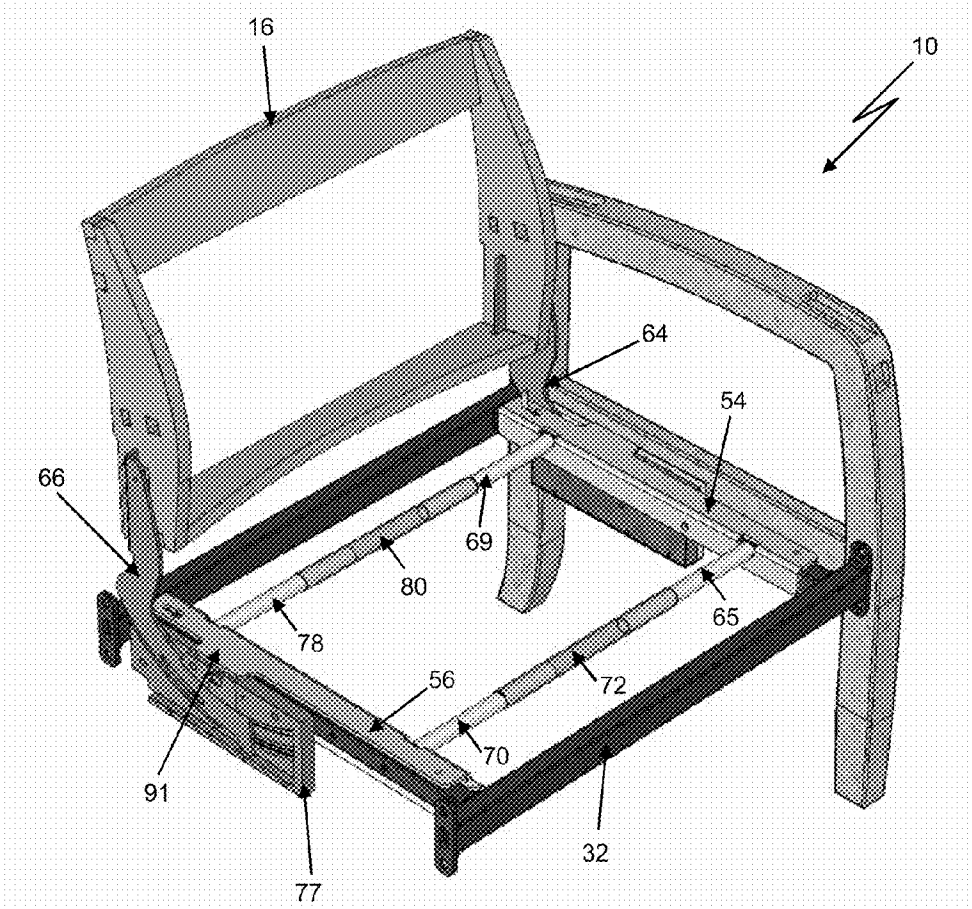
FIG. 6 is a perspective view thereof, with the left arm and left recliner cover plate removed.

Referring now to FIGS. 3-5, the frame 32 includes right and left side frame members 34, 36 and front and rear frame members 40, 46, which are preferably welded together. The frame 32 provides the primary structural support for the seat 18 and backrest 16, as well as attachment points for components of the seat 18. The front and rear frame members 40, 46 each include a mounting flanges 42, 48 at each end for mounting the frame 32 to the arms 12, 14. The side frame members 34, 36 and the front and rear frame members 40, 46 are preferably of tubular metallic construction. The front and rear flanges 42 and 48 are made from metallic bars and include holes for attaching the frame 32 to the arms 12 and 14. The left side frame member 36 preferably include holes, or other attachment points, for the left recliner assembly 76. The right side frame member 34 is a mirror image of the left side frame member 36 and preferably includes the same features.

The seat 18, shown in FIGS. 1*a* and 2, is, in this embodiment, comprised of a seat cushion 50, a seat panel 52 and seat angles 54, 56, right and left cross tubes and couplers 65, 69, 70, 78, 72, 80 (see FIGS. 3-5). The seat 18 is of similar construction to the backrest 16 (FIG. 1). The seat panel 52 is made of sheet material, such as plywood, suitable to provide support for the weight of the seated user, as well as a means of attachment for the seat 18 to the frame 32.

The frame 32 shown in FIGS. 1*a* and 1*b* is 24 inches in width (from arm 12 to arm 14). Other frame widths could be provided for alternative embodiments, such as 20, 32 or 40 inch frames widths.

The right and left seat angles 54, 56 are preferably a single piece fabrication, cut and formed from a sheet of metallic material such as 0.125-0.250 inch thick steel. Details of the left seat angle 56 will be described with the understanding that the right seat angle is a mirror image. The left seat angle is comprised of perpendicular, horizontal and vertical legs 81, 89. The horizontal leg 81 includes key hole slot 58, hole 62 and brake tab 91. Key hole slot 58 and hole 62 provide for attachment of seat panel 52 with the use of fastener 63 shown or other such conventional screws. The seat angle vertical leg 89 includes front and rear cross tube cutouts 60, 61 and seat angle pivot hole 57. The cross tube cutouts 60, 61 in left seat angle 56 locate the respective cross tubes by providing a recessed pocket. The functions of pivot hole 57 and brake tab 91 will be described herein.

FIGS. 3 and 4 show the front and rear left cross tubes 70, 78, front and rear cross tube couplers 72, 80 and front and rear right cross tubes 65 and 69. The cross tubes and cross tube couplers form members that span between the right and left seat angles 54 and 56, maintain dimensional spread, provide additional structural rigidity and multiple widths.

The front and rear right and left cross tubes 65, 69, 70 and 78 are metallic, are circular in cross section and may be identical to each other, for manufacturing simplicity and minimization of part proliferation. The corresponding front and rear cross tube couplers 72, 80 are also metallic, circular in cross section, and each have an inside diameter preferably sized to just slide over the outside diameter of the mating cross tubes. Conventional metallic tubing products are available to meet these requirements. The front and rear cross tube couplers 72 and 80 may be attached to the corresponding cross tubes 65, 69, 70, 78 by a number of conventional mechanical means depending upon manufacturing and assembly practices and preference. In this embodiment, the couplers 72 and 80 are attached to corresponding cross tubes 65, 69, 70, 78 via screws and overlapping holes (not shown). In this embodiment, the front and rear cross tubes 65, 69, 70, 78 are welded to the front and rear cross tube cutouts 60, 61 shown in left seat angle 56 and mirror image cutouts in the right seat angle 54.

The backrest 16, shown in FIGS. 1 and 2 and previously described, reclines and returns to its upright, normal position in response to movement of the seated occupant which results in a shift of weight on the seat, combined with increasing or decreasing force on the backrest 16. The elements of the recliner assemblies that enable such operation will be described in detail.

Referring to FIGS. 3-5, the primary components of left recliner assembly 76 include a left J-bracket 66, the recliner base plate 77, a recliner cover plate 82 and a recliner cover 98. A friction block 84 is shown in FIG. 7 and the spring adjusting screw 88, spring adjusting wheel 90 and the extension spring 92 are shown in FIG. 9.

The recliner cover plate 82 is substantially rectangular, is approximately one third of the thickness of and matches the outside shape of the recliner base plate 77. The recliner cover plate 82 and base plate 77 could be precision molded, cast or machined from metallic or polymeric materials, but in the present invention are molded of polymeric material such as ABS. Polymeric material can provide reduced friction with the J-bracket 66 and molding to net shape can result in a more economical part.

Figure 7:
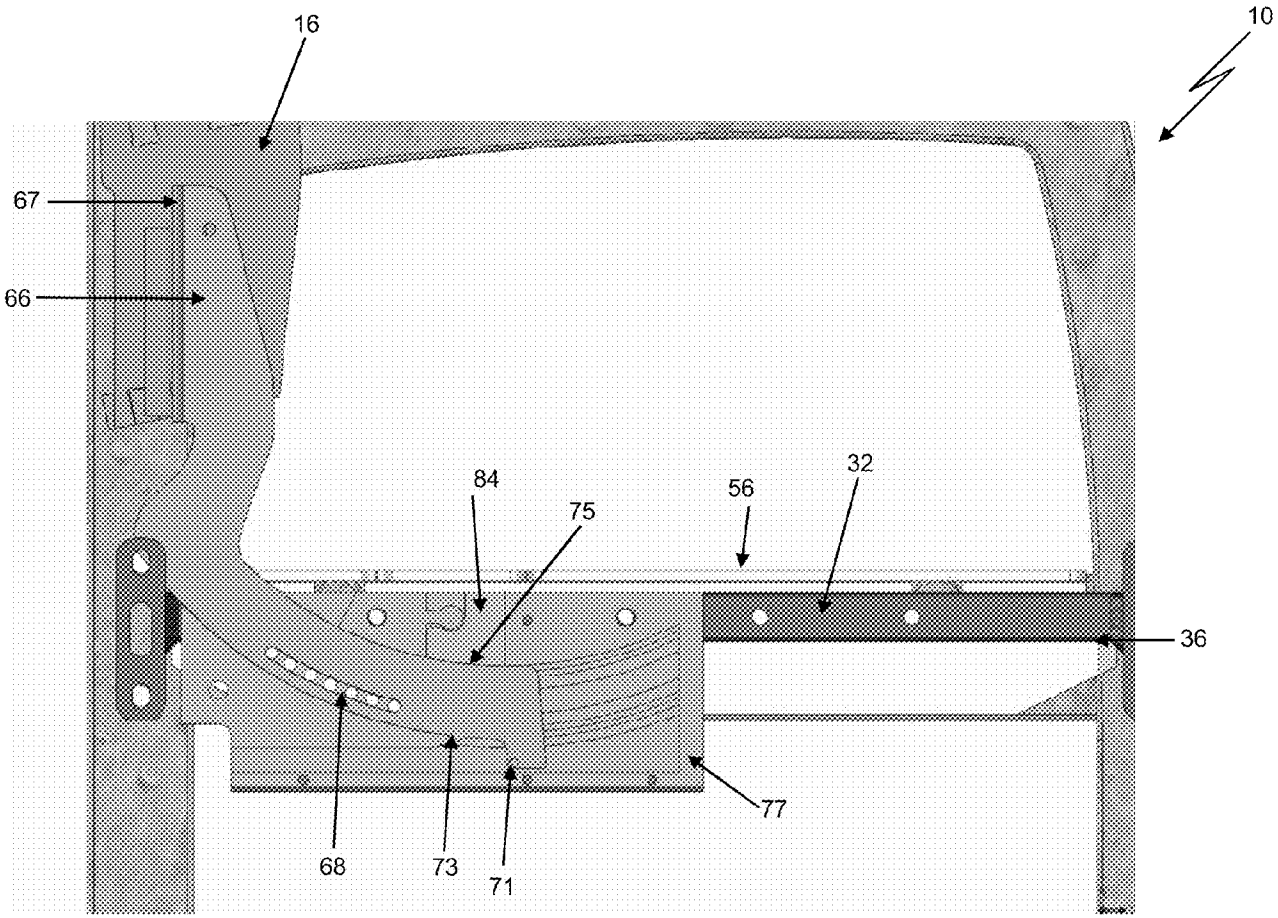
FIG. 7 shows an enlarged partial left side view of FIG. 6.
Figure 8:
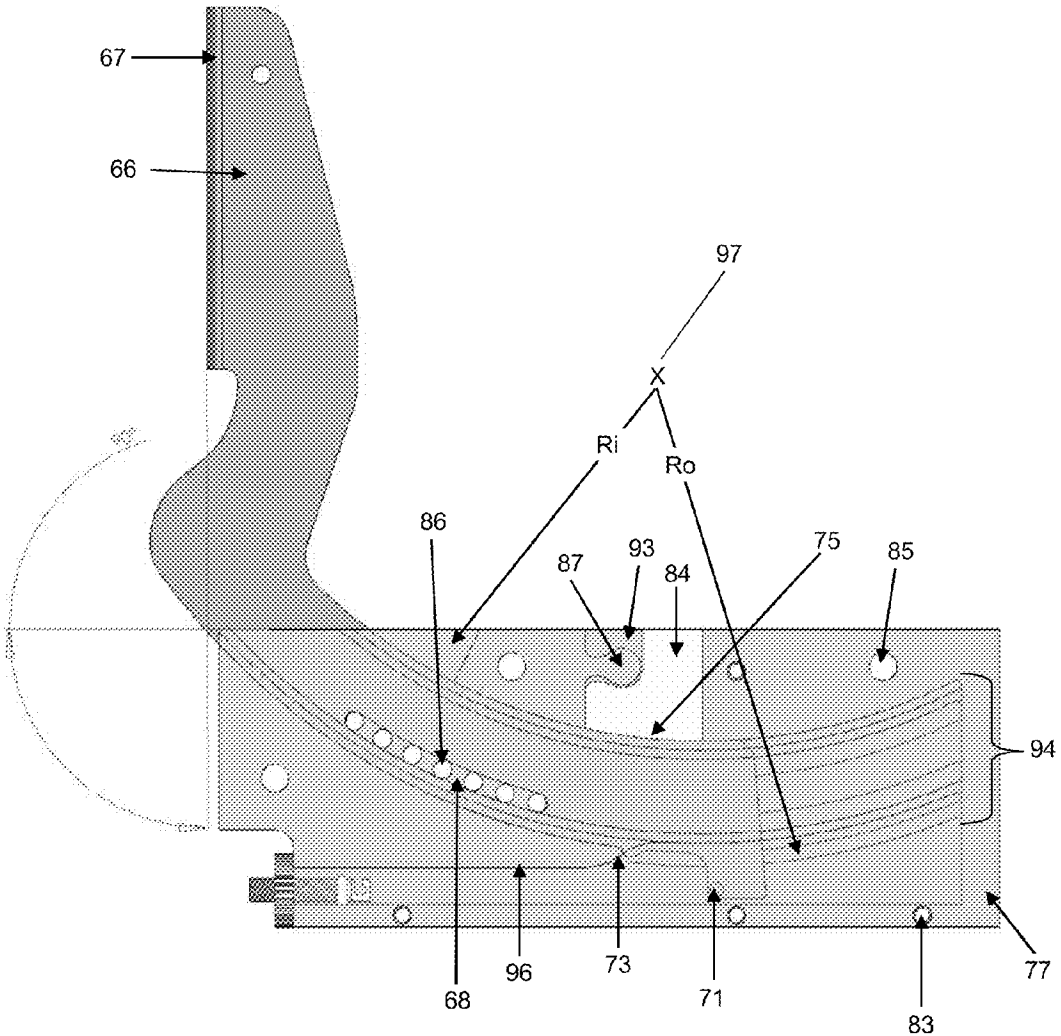
FIG. 8 is a further enlarged partial view of FIG. 7, showing the J-bracket in the upright position.
Figure 9:
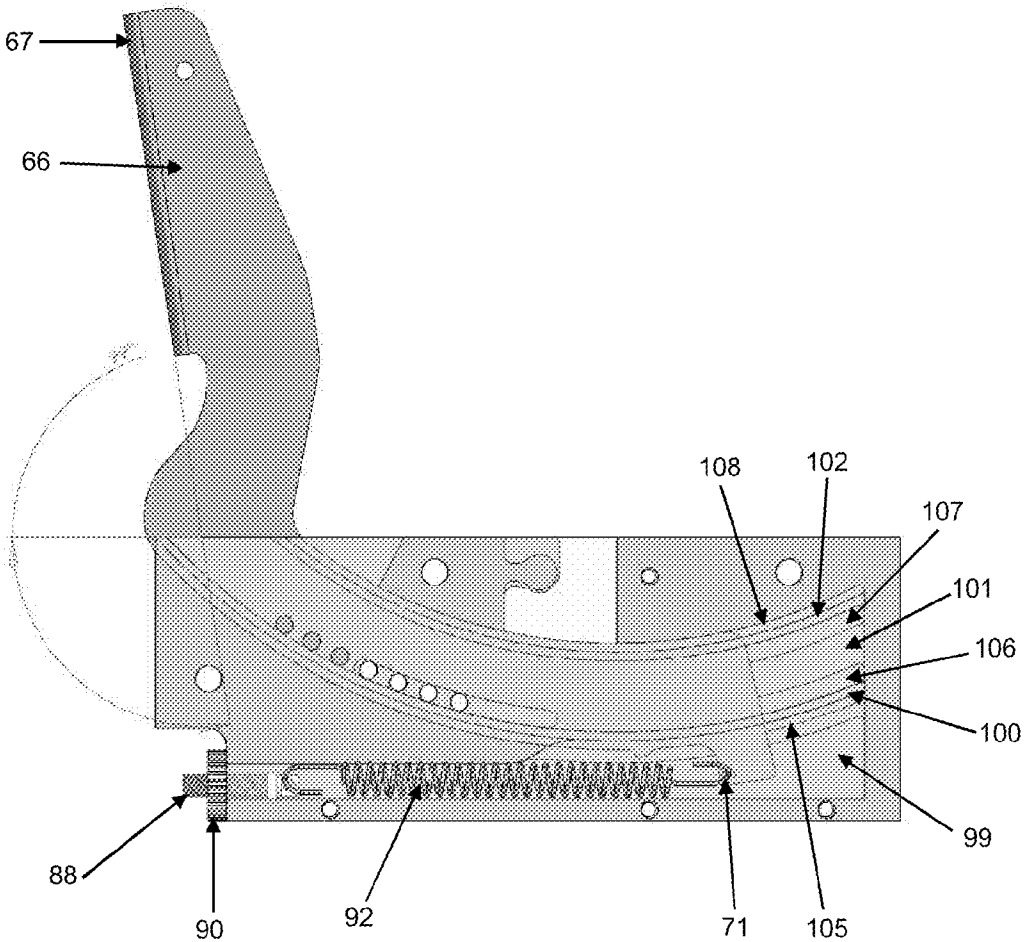
FIG. 9 is a further enlarged partial view of FIG. 7, showing the J-bracket in a partially reclined position and including the recliner spring.

Details of the recliner assembly are shown in FIGS. 7-9. The left J-bracket 66 enables reclining movement of the backrest 16 as it moves through the J-bracket slot 94 in the recliner base plate 77. The top and bottom surface and internal profile detail of the J-bracket slot 94 in the recliner base plate 77 are defined by a series of concentric radii $R_i$ to $R_o$. The recliner base plate 77 inner profile also contains retention protrusion 87 and pocket 93.

The location, configuration, and curvature of the J-bracket 66 and its supporting structures, including the J-bracket slot 94, are designed to allow for a natural reclining motion. To this end, the J-bracket is designed to rotate about an axis 97 (see FIG. 8) that approximates the position of the rotational axis of the hips of a seated user (not shown). The axis 97 corresponds to the center points of the concentric radii $R_i$ to $R_o$ described above. In this embodiment, the axis 97 is located approximately 6.0-6.5 inches above the top of the frame 32 and about 7.5-8.0 inches forward from the center of the rear mounting flange 48. This results in a radius $R_o$ of about 9 inches and a radius $R_i$ of about 7 inches.

The profile of the J-bracket slot 94 is comprised of alternating bearing surfaces 99, 100, 101, 102, which contact the J-bracket 66, and recessed portions 105,106, 107,108, which do not contact the J-bracket 66. Preferably, the recliner cover plate 82 includes a slot (not shown) having a similar profile and location as the J-bracket slot 94 of the recliner base plate 77 and being approximately a mirror image thereof The purpose of providing the recessed portions 105,106, 107,108 on both the recliner base plate 77 and the recliner cover plate 82 is to reduce friction. Alternating the bearing surfaces 99, 100, 101, 102 and recessed portions 105,106, 107,108 provides a stable surface for the J-bracket 66.

The friction block 84 is irregular in shape and is sized to fit snugly but move freely in pocket 93. The thickness of the friction block 84 is less than that of base plate 77. The friction block 84 moves freely in pocket 93, but is limited in its upward motion by protrusion 87. Block 84 could be a reinforced polymer or other material selected to provide the appropriate friction characteristics with the J-bracket 66 and also wear characteristics to result in long life. In this embodiment, the friction block 66 is formed of ABS plastic. Optionally, a lining could be provided between the friction block 84 and the J-bracket 66 to provide a different frictional coefficient and/or to improve wear characteristics.

The friction block 84 is intended to control the ease with which J-bracket 66 moves through the slot 94 in base plate 77, and thus can exert control over how quickly and or easily the backrest 16 is reclined or returned to the upright position. As will be described in greater detail herein, force is applied to the friction block 84 by the seat 18 in proportion to the magnitude of the weight applied by the user to the rearward portion of the seat 18. Therefore, the rearward force required to recline the backrest 16 will be greater for a heavier user seated in the chair than for a lighter user. Optionally, the friction block 84 may provide sufficient friction to prevent the backrest 16 from returning to an upright position when a user leans away from the backrest 16 but remains seated on the seat 18. The backrest 16 would only return to an upright position when the user either shifts his or her weight to the front portion of the seat 18 or removes his or her weight from the seat.

The seat 18 attaches to the frame 32 as explained previously. Referring to FIGS. 3 and 4, left seat angle 56 is attached to left side frame member 36 at hole 57 and through the corresponding hole in the side frame member in a manner that allows the seat 18 to pivot freely. This could be accomplished by using conventional hardware such as a shoulder bolt, a screw and nut, dowel or pin. The occupant of the seat influences the motion of the seat by shifting their weight forward or behind pivot hole 57 while at the same time increasing or decreasing the force applied to backrest 16.

As seat 18 pivots about hole 57, seat angle 56 also pivots and brake tab 91 moves vertically with respect to the recliner assembly 76. Now referring to FIGS. 4 and 8, the left seat angle 56 is shown transparently, so its relationship to the friction block 84 may be seen. A set screw (not shown) or other circular part, such as a dowel or pin inserted in hole 95 in the friction block 84, provides a mechanical connection to transfer motion or force from the pivoting seat angle 56 to the friction block 84. Increasing or decreasing this applied force increases or decreases the normal force, and thereby the frictional force, between the friction block 84 and the J-bracket 66 along the top surface 75 of the J-bracket 66. Increasing or decreasing this frictional force tends to control the ease with which the J-bracket 66 moves through the J-bracket slot 94 and thereby controls the recline motion. The set screw provides a means for adjusting the frictional force applied by the friction block 84 onto the J-bracket 66 in a given seat 18 position, as well as a means for compensating for wear of the friction block 84.

Referring to FIG. 9, a spring assembly includes one end of a spring 92 is attached to the left J-bracket through a hole 71. The other attaches to adjusting screw 88. Both the spring 92 and screw 88 are retained in spring pocket 96. The adjusting screw 88 and wheel 90 are conventionally threaded to allow easy installation and subsequent pre-tensioning of spring 92. Rotation of wheel 90 causes linear movement of screw 88 and increases or decreases the force of spring 92. The force of spring 92 tends to hold backrest 16 in its normal upright position and as backrest 16 is reclined the increasing spring force tends to balance the force applied to the backrest by the occupant adding resistance to the reclining motion and resulting in smooth motion. If the backrest 16 is reclined, the force in spring 92 will also aid in its return to the upright position. The right J-bracket 64 and right recliner assembly 79 function similarly and both right and left recliner assemblies 76 and 79 work in unison to provide control of the recline function. Preferably the occupant of seat 10 need only to tip slightly forward or backward to enable easy, smooth recline motion in the same direction.

The labeled holes 83 and 85 and the other holes shown are representative of many possible patterns that could provide for assembly of the recliner cover 98, cover plate 82 and base plate 77 and attachment of the recliner assembly 76 to the left frame member 36 as shown in FIG. 4.

Limit pin hole 86 is one of a series of co-axial holes in the recliner base plate 77, cover plate 82 and cover 98 that when fitted with a circular pin, dowel or other suitable tubular part, not shown, provides a recline position stop that varies the recline angle "A" when it reaches the end of stop slot 68. Recline angle "A" would typically be set at factory assembly.

The J-bracket 66 is preferably a single piece fabrication, precision cut, such as with a laser or blanked, and is preferably formed from a sheet of metallic material such as 0.125-0.250 inch thick steel. Alternatively, it could be constructed as a multi-piece welded metallic structure or a single piece molded part of appropriate strength polymer material. The J-bracket 66 is of irregular periphery with its upper and lower radii closely matching R, and Ro in the J-bracket slot 94. Other details include a lateral tab 67 that provides the attaching structure for the backrest 16, stop slot 68 in which the circular pin, dowel or other suitable tubular part mentioned above travels, spring attaching hole 71 and limit stop 73. The J-bracket lateral tab 67 slides into a correspondingly shaped slot (not numbered in the figures) in the left side panel 26. A screw or other fastener is preferably provided to prevent the left side panel 26 from unintentionally disconnecting from the left lateral tab 67. A limit stop 73 provides a mechanical stop for the upright position of backrest 16 within the profile detail of J-bracket slot 94.

The left recliner cover 98 in FIGS. 2 and 4 for this example is shown as a thin sheet metallic part with a rectangular periphery, a multiplicity of hole patterns and multiple bends to allow it to match and fit over the left recliner base plate 77 and cover plate 82 that, along with the other parts previously described, make up the left recliner assembly 76. The material could be sheet steel of 0.031-0.093 thickness. It provides a finished look to the recliner assembly 76 and provides a hard bearing surface for the attaching hardware.

Embodiments of the present invention also include a modular system of components that enable one or more seating units to be assembled in a spanned configuration or a ganged configuration using the same parts as are used for each unit when assembled in a single-unit configuration. See U.S. provisional application Ser. No. 60/733,866, incorporated herein by reference. As used herein, a "spanned" configuration refers to a furniture configuration in which multiple frames are joined without arms located between the joined frames (see FIG. 11). In a spanned configuration, the two arms are located at each end. As used herein, a "ganged" configuration refers to a furniture configuration in which multiple frames are joined with arms located between each of the joined frames (see FIG. 12). In a ganged configuration, the number of arms is usually one greater than the number of joined frames in the configuration.

As used herein, the term seating "unit" refers to any furniture items that can be assembled in a single-unit configuration, most often with a single-piece frame. The parts and single-configuration assembly for each of these seating units are briefly described herein.

Figure 11:
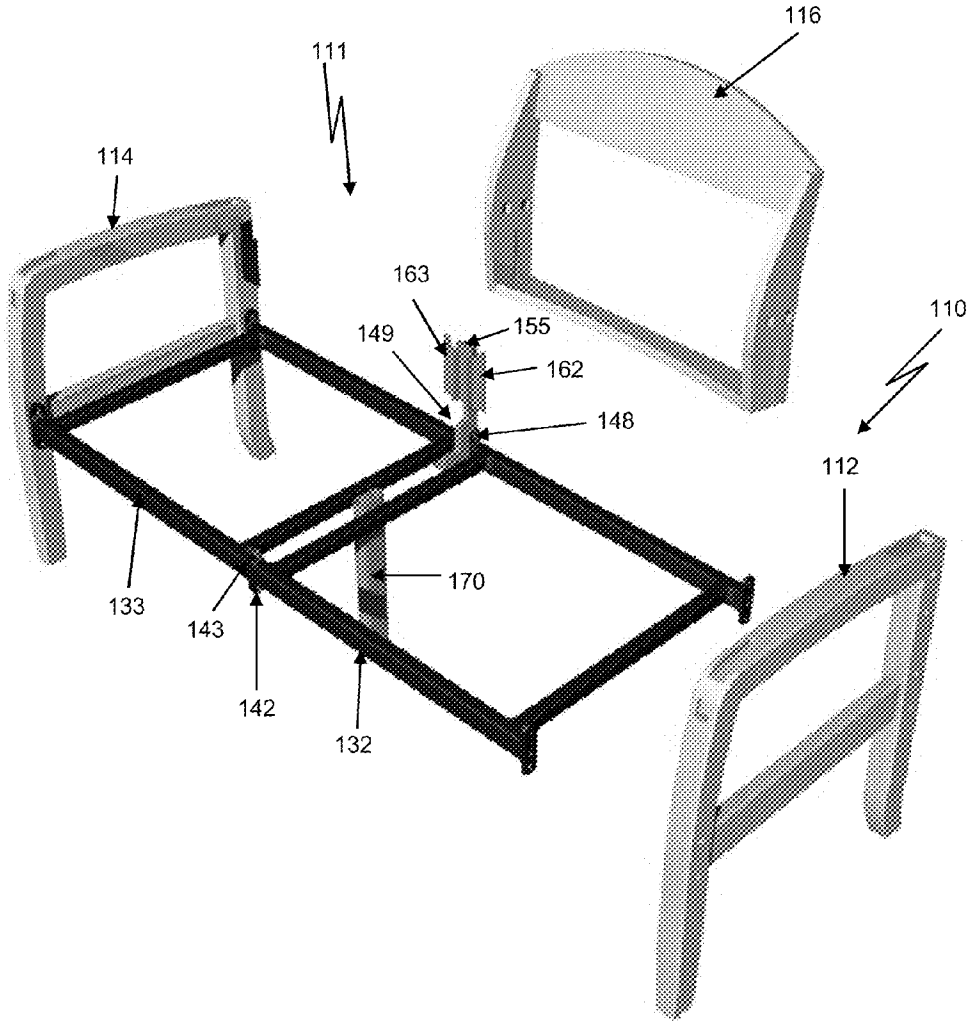
FIG. 11 is partially exploded perspective view of two chair units arranged in a spanned configuration.

A spanned configuration comprising two chair units 110 and 111 is shown in FIG. 11. This configuration includes two frames 132, 133 which are jointed by bolting their adjoining front flanges 142, 143. As in the chair embodiment (FIG. 1), the outer ends of the frames 142, 143 are bolted to right and left arms 112, 114. A center backrest bracket 155 is bolted between the rear flanges 148, 149 and provides an attachment point for the right backrest 116 and the left backrest (not shown). The center backrest bracket 155 includes two opposing backrest flanges 162, 163. In this embodiment, the left backrest is identical to the right backrest 1 16. As in the chair embodiment, a right backrest bracket (not shown) and a left backrest bracket 156 are attached to the right and left arms 112, 114, respectively, and the backrests are, in turn, attached to the backrest brackets. In order to provide additional stability, a center leg 170 may be located between the frames 132, 133 and affixed thereto using any suitable means of attachment, such as a bolt or pin, for example. Alternatively, a single, wider backrest (see e.g., FIG. 12) could be used an the spanned configuration instead of two backrests. In order to provide even spacing between the frames 132, 133 from front to rear, a spacer (not shown), equal in width to the portion of the center backrest bracket 155 located between the rear flanges 148, 149, may be provided between the front flanges 142, 143.

As should be evident from comparing FIGS. 1-2 with FIG. 11, many of the components of the spanned configuration are the same as those used in single unit chairs 10. The frame 32, arms 12, 14, backrest 16, backrest brackets 54, 57 and seat 18 used in the stationary chair 10 can be the same as the corresponding parts used in the spanned configuration. In this embodiment, the only parts that are unique to the spanned configuration are the center leg 170, the center backrest bracket 155 and the optional spacer located between the front flanges 142, 143.

Figure 10:
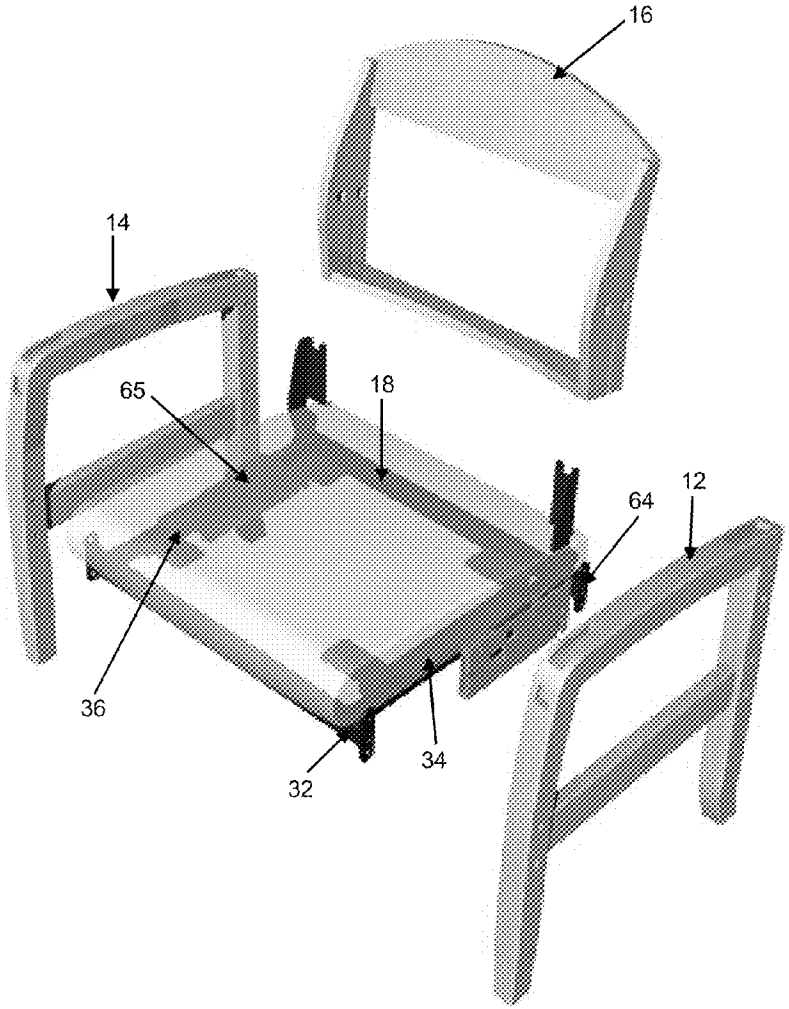
FIG. 10 is a partially exploded perspective view of a recliner chair, in which the seat cushion is shown translucently in order to show the internal parts of the chair.

The spanned configuration shown in FIG. 11 could incorporate frames of different lengths. When using a recliner unit (FIG. 10) as part of a spanned configuration more than two frames is not recommended, due to the additional lateral and dynamic stress associated with the recliner units.

Figure 12:
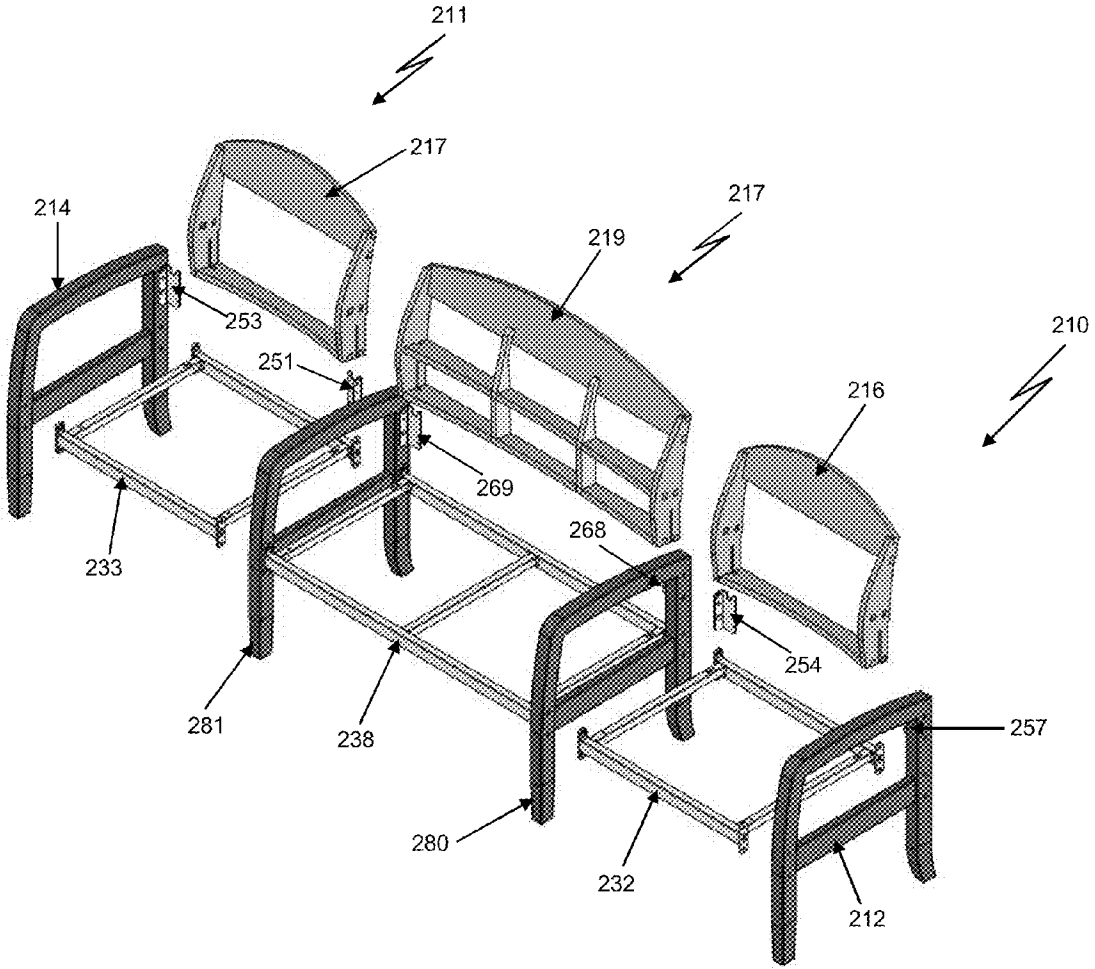
FIG. 12 is partially exploded perspective view of two chair units and a loveseat unit arranged in a ganged configuration.

A ganged configuration of the present invention is shown in FIG. 12, which comprises two chair units 210, 211 and a seat unit 217, which includes a single 40-inch wide frame 238. The seat unit 217 can accommodate either two 20-inch seats or a single 40-inch seat. As shown in FIG. 12, a ganged configuration is constructed by having adjoining units share a single arm. In this embodiment, two center arms 280, 281 are provided. The right chair frame 232 is attached to the out side of the right center arm 280 and the right end of the double-seat frame 238 is attached to the inner side of the right center arm 280. Similarly, the left chair frame 233 is attached to the out side of the left center arm 281 and the left end of the double-seat frame 238 is attached to the inner side of the left center arm 281.

Left and right arms 212, 214 are attached to the outer ends of the right and left frames 232, 233, respectively. In this embodiment, the left and right arms 212, 214 are identical to the center arms 280, 281 (i.e., having mounting holes on both sides). This would allow for additional part efficiency. Alternatively, the left and right arms 212, 214 could have mounting holes only on their inner sides.

The two chair units 210, 211 include backrests 216, 217, backrest brackets 251, 253, 254, 257 and seats (not shown), which are the same as the corresponding parts used in the single unit chair 10. The frames 232, 233 and arms 212, 214 are also preferably the same as the corresponding parts in the single chair 10. Similarly, the double-seat unit 217 uses the same frame 238, backrest 219, backrest brackets, seat (not shown) as in a single unit double seat (not shown).

Many other possible ganged configurations are possible, including, but not limited to, recliner or glider units, ganging more than three frames, providing right-angle corner frames.

Figure 13:
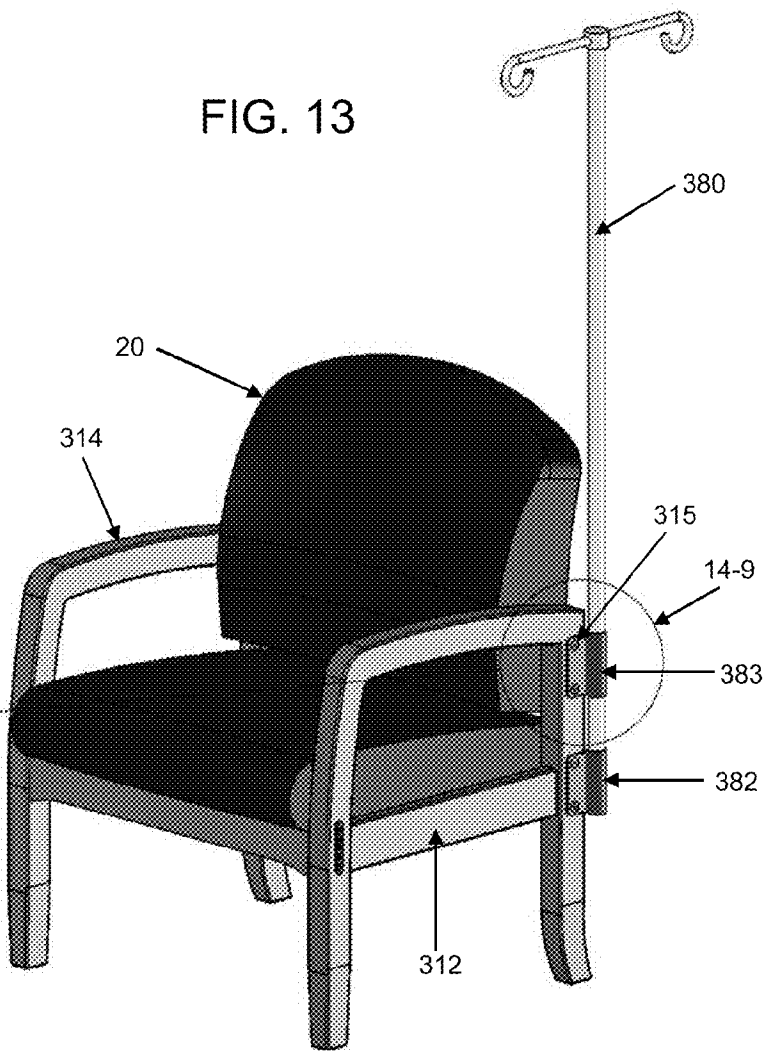
FIG. 13 is a perspective view of the chair shown in FIG. 1, shown with an IV stand attached to the right arm.
Figure 14:
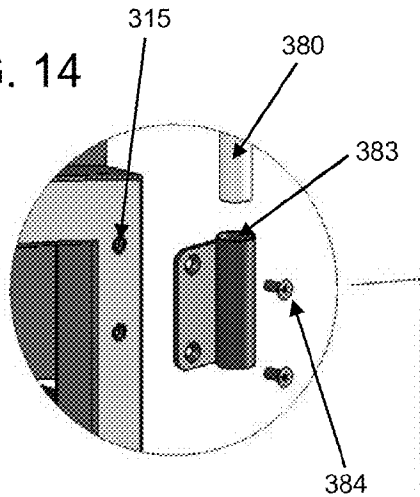
FIG. 14 is an enlarged view of the portion of FIG. 13 shown in area 14-9.

FIGS. 13-16 show optional uses of the mounting holes 315 on the outer sides of the arms 312, 314. FIGS. 13-14 show an IV pole 380 attached to the right arm 312 by two mounting brackets 382, 383, which are secured to arm 312 at the mounting holes 315 by screws 384. The IV pole 380 shown in FIGS. 13-14 is merely intended to be exemplary of the multitude of accessories that could be attached to the arms 312, 314, such as magazine racks, drain bags, trays, or flexible lighting, for example.

Figure 16:
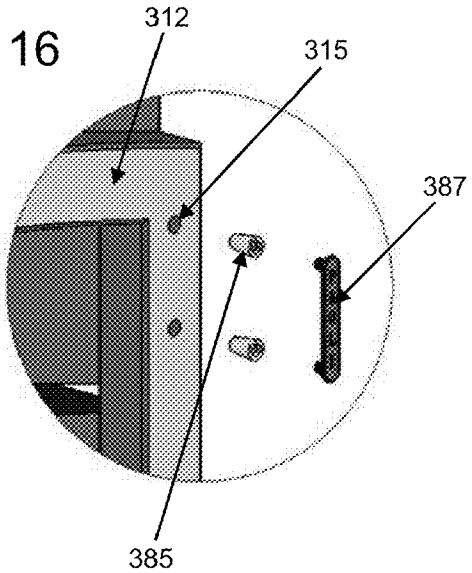
FIG. 16 is an enlarged view of the portion of FIG. 15 shown in area 16-11.
Figure 15:
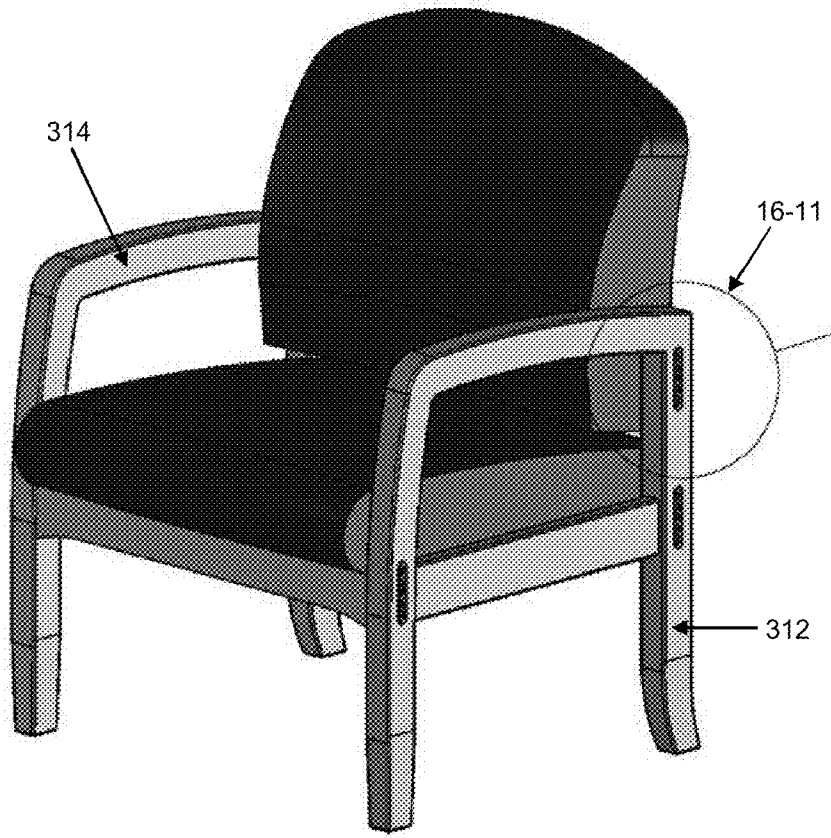
FIG. 15 is a perspective view of the stationary chair shown in FIG. 1*a*, shown with a plug covering the exterior holes in the right arm.

FIGS. 15-16 shows a cover 387 which can be used to cover the mounting holes 315 when they are not being used to support accessories. Each cover 387 preferably spans two mounting holes 315 and includes a tapered plug 385 for each covered mounting hole 315. The cover 387 prevents debris and other foreign objects from damaging the mounting holes 315, as well as providing an attractive appearance and space to display a product name or other trademark thereon.

While the principles of the invention have been described above in connection with preferred embodiments, it is to be clearly understood that this description is made only by way of example and not as a limitation of the scope of the invention.

The invention claimed is:

1. A reclining chair comprising:

a chair frame comprising front and rear frame members, two parallel side frame members each side frame member attachable to the front and rear members;

a seat supported by at least two frame members;

a backrest;

a pair of legs, wherein the frame members are connected to the legs;

cross tubes and cross tube couplers for maintaining dimensional spread, providing additional structural rigidity and multiple widths; and first and second recliner assemblies each comprising a bracket, the bracket attachable to the backrest enabling reclining movement of the backrest as the bracket moves through a correspondingly shaped bracket slot in a recliner base plate, wherein the bracket rotates about an axis that approximates the position of the rotational axis of the hip of a seated user.

2. The reclining chair of claim 1 wherein the backrest includes a backrest support structure.

3. The reclining chair of claim 1 wherein the bracket is a J-bracket.

4. The reclining chair of claim 3 wherein the recliner base plate includes a retention protrusion and pocket.

5. The reclining chair of claim 1 wherein the recliner assembly includes a recliner cover, and a recliner cover plate.

6. The reclining chair of claim 5 wherein the recliner cover plate includes a slot having alternating bearing surfaces which are in contact with the bracket and recessed portions which do not contact the bracket.

7. The recliner of chair 1 wherein the slot comprises alternating bearing surfaces which are in contact with the bracket and recessed portions which do not contact the bracket.

8. The reclining chair of claim 1 further comprising a first and second seat angle attached to each of the side chair frame members.

9. The reclining chair of claim 1 wherein the bracket is attached to the backrest by a bracket lateral tab.

10. The reclining chair of claim 1 wherein the recliner assembly comprises a spring mechanism positioned in a spring pocket in the recliner base plate, the spring mechanism being operably connected to the bracket.

11. The reclining chair of claim 1 wherein the bracket further comprises an adjustable friction block having friction characteristics with the bracket and providing friction between the friction block and the top surface of the bracket.

12. The reclining chair of claim 1 wherein top and bottom surface of the bracket slot is defined by concentric radii $R_i$ to $R_o$.

13. The reclining chair of claim 12 wherein the radius $R_o$ is about 9 inches and the radius $R_i$ is about 7 inches.

14. The reclining chair of claim 1 wherein the axis is approximately 6.0-6.6 inches above the top of the frame and about 7.5-8.0 inches forward from the center of the rear frame member.

15. The reclining chair of claim 1 wherein the recliner is part of a modular system which comprises one or more chair recliners.

16. The reclining chair of claim 15 wherein the one or more chair recliners are assembled in a spanned configuration or a ganged configuration.

17. A reclining chair comprising:

a chair frame comprising front and rear frame members, two parallel side frame members each side frame member attachable to the front and rear members;

a seat supported by at least two frame members;

a backrest;

a pair of legs, wherein the frame members are connected to the legs; and first and second recliner assemblies each comprising a bracket, the bracket attachable to the backrest enabling reclining movement of the backrest as the bracket moves through a correspondingly shaped bracket slot in a recliner base plate, the slot comprises alternating bearing surfaces which are in contact with the bracket and recessed portions which do not contact the bracket, wherein the bracket rotates about an axis that approximates the position of the rotational axis of the hip of a seated user.

18. A reclining chair comprising:

a chair frame comprising front and rear frame members, two parallel side frame members each side frame member attachable to the front and rear members;

a seat supported by at least two frame members;

a backrest;

a pair of legs, wherein the frame members are connected to the legs; and first and second recliner assemblies each comprising a bracket, the bracket attachable to the backrest enabling reclining movement of the backrest as the bracket moves through a correspondingly shaped bracket slot in a recliner base plate, the first and second recliner assemblies each further comprising a recliner cover and a recliner cover plate, the recliner cover plate including a slot having alternating bearing surfaces which are in contact with the bracket and recessed portions which do not contact the bracket, wherein the bracket rotates about an axis that approximates the position of the rotational axis of the hip of a seated user.

19. A reclining chair comprising:

a chair frame comprising front and rear frame members, two parallel side frame members each side frame member attachable to the front and rear members;

a seat supported by at least two frame members;

a backrest;

a pair of legs, wherein the frame members are connected to the legs; and first and second recliner assemblies each comprising a bracket, the bracket attachable to the backrest enabling reclining movement of the backrest as the bracket moves through a correspondingly shaped bracket slot in a recliner base plate, wherein the each recliner assembly further comprises a spring mechanism positioned in a spring pocket in the recliner base plate, the spring mechanism being operably connected to the bracket, and wherein the bracket rotates about an axis that approximates the position of the rotational axis of the hip of a seated user.

20. A reclining chair comprising:

a chair frame comprising front and rear frame members, two parallel side frame members each side frame member attachable to the front and rear members;

a seat supported by at least two frame members;

a backrest;

a pair of legs, wherein the frame members are connected to the legs; and first and second recliner assemblies each comprising a bracket, the bracket attachable to the backrest enabling reclining movement of the backrest as the bracket moves through a correspondingly shaped bracket slot in a recliner base plate, wherein the bracket further comprises an adjustable friction block having friction characteristics with the bracket and providing friction between the friction block and the top surface of the bracket, and wherein the bracket rotates about an axis that approximates the position of the rotational axis of the hip of a seated user.

* * * * *

UNITED STATES PATENT AND TRADEMARK OFFICE

CERTIFICATE OF CORRECTION

PATENT NO. : 7,708,345 B2
APPLICATION NO. : 11/556464
DATED : May 4, 2010
INVENTOR(S) : Daniel Grabowski et al.

It is certified that error appears in the above-identified patent and that said Letters Patent is hereby corrected as shown below:

On the cover page, in (73) Assignee: delete "Mascatine" and insert therefor
--Muscatine--

Signed and Sealed this

Eighth Day of June, 2010

David J. Kappos

David J. Kappos
*Director of the United States Patent and Trademark Office*